US008511370B2

(12) United States Patent
Deivasigamani et al.

(10) Patent No.: US 8,511,370 B2
(45) Date of Patent: Aug. 20, 2013

(54) HEAT EXCHANGER INCLUDING SELECTIVELY ACTIVATED CATHODIC PROTECTION USEFUL IN SULFIDE CONTAMINATED ENVIRONMENTS

(75) Inventors: Sridhar Deivasigamani, Peoria, IL (US); Herman S. Preiser, Annapolis, MD (US)

(73) Assignee: Caterpillar Inc., Peoria, IL (US)

( * ) Notice: Subject to any disclaimer, the term of this patent is extended or adjusted under 35 U.S.C. 154(b) by 1307 days.

(21) Appl. No.: 12/276,097

(22) Filed: Nov. 21, 2008

(65) Prior Publication Data

US 2010/0126698 A1 May 27, 2010

(51) Int. Cl.

| | |
|---|---|
| ***F28F 27/00*** | (2006.01) |
| ***F28F 9/02*** | (2006.01) |
| ***F28F 19/00*** | (2006.01) |
| ***F28D 7/10*** | (2006.01) |
| ***F28D 7/02*** | (2006.01) |
| ***B60H 1/00*** | (2006.01) |
| ***C23F 13/00*** | (2006.01) |

(52) U.S. Cl.

USPC ..... 165/200; 165/157; 165/158; 165/164; 165/11.1; 165/134.1; 204/196.02; 204/196.04; 204/196.1; 204/196.33; 204/196.36; 204/196.37; 205/725; 205/730; 205/740

(58) Field of Classification Search

USPC ..... 165/157, 158, 164, 11.1, 200, 271, 165/133, 134.1; 204/196.02, 196.04, 196.1, 204/196.33, 196.36, 196.37; 205/725, 730, 205/740

See application file for complete search history.

(56) References Cited

U.S. PATENT DOCUMENTS

| | | | | |
|---|---|---|---|---|
| 1,020,480 | A * | 3/1912 | Cumberland | 204/196.31 |
| 1,335,209 | A | 3/1920 | Wurstemberger | |
| 1,335,210 | A | 3/1920 | Wurstemberger | |
| 2,784,156 | A | 3/1957 | Maurin | |
| 2,941,953 | A | 6/1960 | Hatch | |
| 3,530,051 | A | 9/1970 | Ueda et al. | |
| 3,900,348 | A | 8/1975 | Zukriegel et al. | |
| 3,984,302 | A | 10/1976 | Freedman et al. | |
| 4,202,751 | A | 5/1980 | Fukuzuka et al. | |
| 4,668,474 | A | 5/1987 | Gill et al. | |
| 4,744,950 | A | 5/1988 | Hollander | |
| 4,776,384 | A * | 10/1988 | Kawabe et al. | 165/133 |
| 4,776,392 | A * | 10/1988 | Loyd | 204/196.16 |
| 4,822,465 | A * | 4/1989 | Jones et al. | 204/192.1 |
| 5,128,065 | A | 7/1992 | Hollander | |
| 2007/0023295 | A1 * | 2/2007 | Dowling | 205/724 |
| 2007/0095732 | A1 | 5/2007 | Lutz | |

OTHER PUBLICATIONS

Roberge, P.R., (2000) Handbook of Corrosion Engineering, McGraw-Hill, p. 656.*

* cited by examiner

*Primary Examiner* — Frantz F. Jules
*Assistant Examiner* — Erik Mendoza-Wilkenfel
(74) *Attorney, Agent, or Firm* — Leydig, Voit & Mayer

(57) ABSTRACT

A heat exchange system including a heat exchanger having a housing and a cooling core disposed within in the housing. The cooling core is adapted to receive a flow of a liquid cooling media. The heat exchanger includes at least one iron anode projecting into a flow path of the liquid cooling media. The heat exchange system also includes an electronic control module operatively connected to the iron anode. The electronic control module is adapted to control the selective delivery of electrical current or grounding to the iron anode in response to predetermined conditions indicating the presence of sulfide constituents in the cooling medium.

17 Claims, 3 Drawing Sheets

HEAT EXCHANGER INCLUDING SELECTIVELY ACTIVATED CATHODIC PROTECTION USEFUL IN SULFIDE CONTAMINATED ENVIRONMENTS

TECHNICAL FIELD

This patent disclosure relates generally to heat exchangers and more particularly to the prevention of electrolytic corrosion of a heat exchanger cooling core when exposed to an electrolyte including sulfide contaminants.

BACKGROUND

Corrosion in heat exchangers has long been a problem. It is generally recognized that one of the causes of this deterioration is the electrolytic action between the dissimilar metals of the various components. This process, referred to as electrolysis, produces a flow of current between the two unlike metal areas when in the presence of an electrolyte, such as ionized natural waters, which in turn causes corrosion on the more active metal (anode) and forms a protective film on the less active metal (cathode).

To increase life, a sacrificial material may be used with heat exchangers prone to produce a current flow. Zinc, being very unstable as evidenced by its position in the galvanic series, has been used as a sacrificial material to reduce the deterioration of copper alloy tubes and other metal structures in the highly dense structure of shell and tube type heat exchangers which use ionized water such as seawater or lake water as the cooling medium. One such system is disclosed in U.S. Pat. No. 4,776,392 to Loyd, having an issue date of Oct. 11, 1988. In that system, zinc rods are positioned in the end caps of the heat exchanger and are grounded to the engine using an electrical conducting member. The reaction of the cooling medium and the rod suppresses electrolytic damage to the core.

SUMMARY

This disclosure describes, in one aspect, a heat exchange system including a heat exchanger having a housing and a cooling core disposed within the housing. The cooling core is adapted to receive a flow of a liquid cooling medium. The heat exchanger includes at least one iron anode projecting into a flow path of the liquid cooling medium. The heat exchange system also includes an electronic control module operatively connected to the iron anode. The electronic control module is adapted to control the selective grounding of the iron anode in response to predetermined conditions indicating the presence of sulfide constituents in the cooling medium.

This disclosure describes, in another aspect, a method of providing enhanced corrosion protection to copper alloy surfaces within a cooling core of a heat exchanger adapted to receive an ionized aqueous cooling medium wherein the copper alloy surfaces have a pre-established protective oxide film coating. The method includes providing at least one iron anode projecting into a flow path of the cooling medium upstream of the cooling core. The method further includes generating ferrous ions and free electrons from the iron anode by selectively grounding the iron anode in response to predetermined conditions indicating the presence of sulfide constituents in the cooling medium.

BRIEF DESCRIPTION OF THE DRAWING(S)

DETAILED DESCRIPTION

Figure 1:
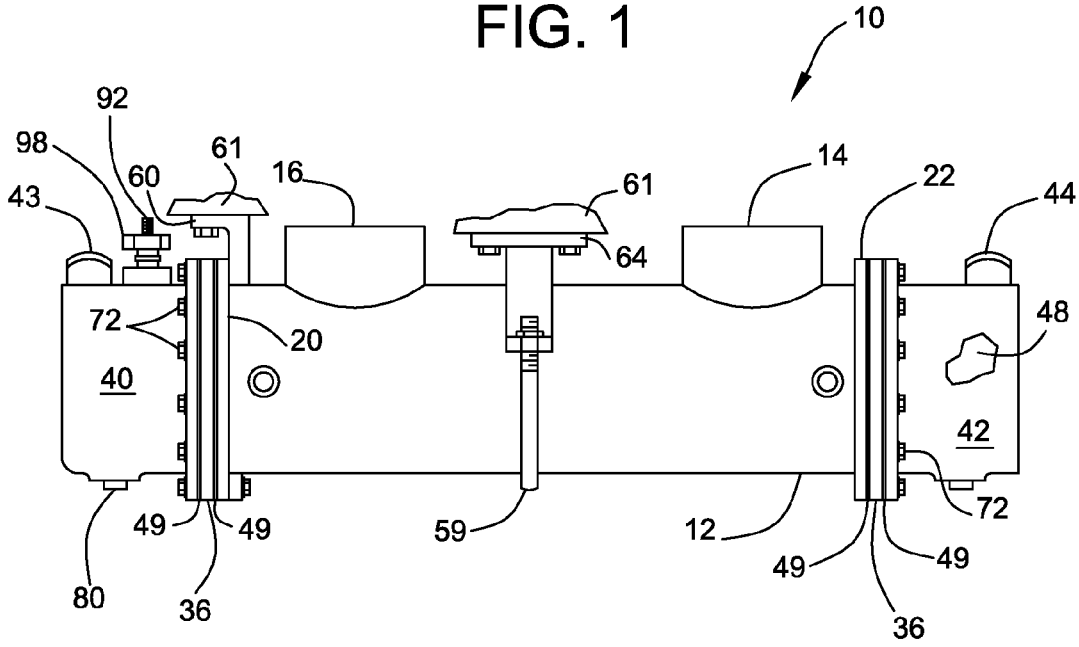
FIG. 1 is a diagrammatic side view of an exemplary heat exchanger.

Reference will now be made to the drawings, wherein, to the extent possible, like reference numerals are used to designate like elements in the various views. In reference to FIG. 1, a heat exchanger 10 includes a housing 12 such as a tank structure having an inlet 14 and an outlet 16 through which the fluid to be cooled can flow. In this regard, the fluid to be cooled may be in a liquid state such as oil or other liquid, or in a gaseous state such as air or other gas. As shown through joint reference to FIGS. 1 and 2, the illustrated housing 12 includes an inner surface 18, a first end surface 20 and a second end surface 22. The first end surface 20 and the second end surface 22 are of generally annular construction and include an arrangement of threaded holes 24, one of which is shown at FIG. 2.

A cooling core 30 is positioned in the housing 12. According to the illustrated exemplary construction, the cooling core 30 includes a plurality of copper alloy tubes 32 held in spaced relation from the inner surface 18 by a pair of end sheets 34 (only one shown) and a plurality of baffles, not shown. While the use of copper alloy tubes 32 may be desirable in many applications, it is likewise contemplated that the cooling core 30 may include any number of other heat exchange elements, including tubes formed from other materials or non-tube structures formed copper alloy or other materials. The end sheets 34 are in sealed relationship to the tubes 32. In the illustrated construction, the end sheets 34 are surrounded by a flange 36 including an arrangement of holes adapted for alignment with the threaded holes 24 in the first end surface 20 and the second end surface 22 of the housing 12.

A first end cover 40 and a second end cover 42 are connected to the housing 12 at the first end surface 20 and the second end surface 22, respectively. The first end cover 40 and the second end cover 42 are constructed from any suitable material. By way of example only, exemplary materials for forming the first end cover 40 and/or the second end cover 42 may include a cupro-nickle alloy, gunmetal, brass and plastics. In many environments of use it may be desirable that the first end cover 40 and/or the second end cover 42 be substantially non-conducting. By way of example only, one class of material that may be useful for constructing the first end cover 40 and/or the second end cover 42 of non-conducting character is a Nylon resin plastic although other polymeric or non-polymeric materials may likewise be used if desired.

In the exemplary construction which is illustrated, the first end cover 40 has a cooling medium inlet 43 for introduction of a cooling medium such as ionized seawater, lake water or the like. The second end cover 42 includes a cooling medium outlet 44 for expulsion of the cooling medium. As shown in FIG. 2, the first end cover 40 defines a first end chamber 45 bounded by the interior walls of the first end cover 40 and the adjacent end sheet 34. The second end cover 42 defines a second end chamber 48 of similar construction. Gaskets 49 are positioned on each side of the flange 36. The gaskets 49 have a plurality of holes therein corresponding to the plurality of threaded holes 24 in the housing 12. The first end cover 40 and the second end cover 42 each includes a plurality of through holes therein which correspond to the plurality of threaded holes 24 in the housing 12. In the illustrated construction, an electrical conducting sleeve 53 of metal or other conducting material is disposed in at least one of the through holes in the first end cover 40 and the second end cover 42.

In the exemplary construction incorporating a first end cover 40, and a second end cover 42 of non-conducting character, the first end cover 40, and a second end cover 42 include at least one electrical conducting insert 56 disposed therein. The electrical conducting insert 56 is connected in an electrically conducting relationship to the electrical conducting sleeve 53 by an electrical conducting member 58 extending between the electrical conducting sleeve 53 and the electrical conducting insert 56. In this application, the electrical conducting member 58 may be brazed to the electrical conducting sleeve 53 and the electrical conducting insert 56. However, any appropriate method of insuring electrical conduction could be used. In the illustrated exemplary construction, the electrical conducting member 58 is electrically insulated by the polymer used to form the first end cover 40 and the second end cover 42.

Figure 2:
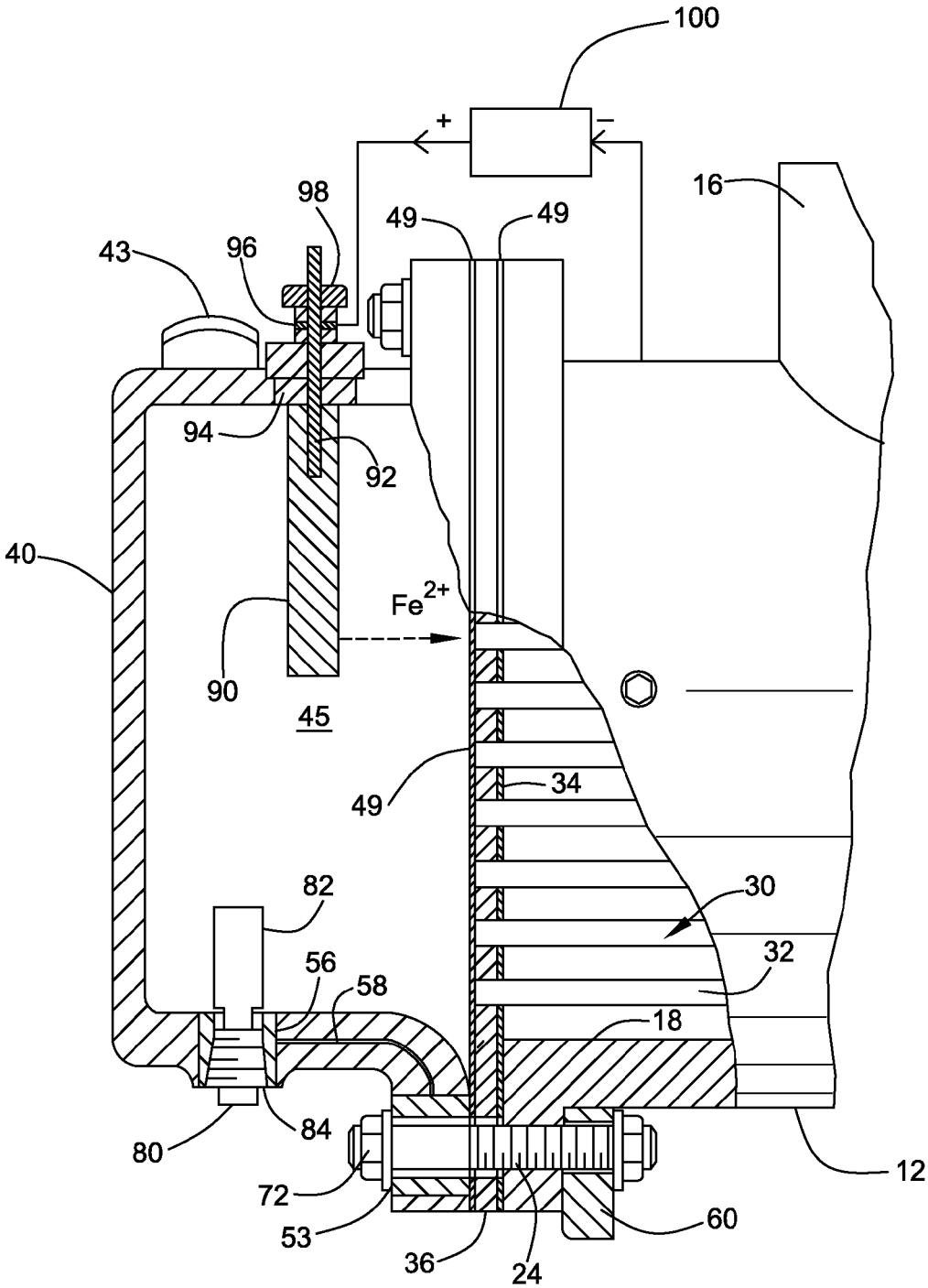
FIG. 2 is an enlarged partial sectional view of an end portion of the heat exchanger illustrated in FIG. 1.

In the exemplary arrangement which is illustrated, a first bracket 59 and a second bracket 60 are used to attach the heat exchanger 10 to an engine 61 illustrated in partial section as shown in FIG. 1. In the illustrated arrangement, the first bracket 59 includes a U-bolt straddling the housing 12 and a support member 64 connected to the engine 61 to provide a grounded circuit. Thus, the housing 12 is grounded through the bracket to the engine. The second bracket 60 is likewise operatively connected to the engine 61 to provide a grounded circuit.

As best shown in FIG. 2, a plurality of bolts 72 threadably engage the threaded holes 24 at the first end surface 20 and connect the first end cover 40 to the housing 12. At the other end of the housing 12, the bolts 72 threadably engage the threaded holes 24 at the second end surface 22 and connect the second end cover 42 to the housing 12. The bolts 72 extend through the electrical conducting sleeve 53.

In the illustrated exemplary arrangement, a rod 80 is removably attached within each of the first end cover 40 and the second end cover 42. The rod 80 has a zinc sacrificial material 82 extending into the first end chamber 45 and the second end chamber 48 respectively. The zinc sacrificial material 82 is attached to a conducting base 84 of brass or other conducting material. The conducting base 84 is threadably attached to the electrical conducting insert 56. In this construction, the electrical conducting member 58 establishes an electrical connection between the zinc sacrificial material 82 and the bracket 60 to provide a continuous grounded condition.

As best seen in FIG. 2, the heat exchanger 10 also includes an iron anode 90 held within the end cover 40 adjacent to the inlet 43 for contact with the cooling medium prior to delivery to the cooling core 30. By way of example only, the iron anode 90 may be mounted on an elongate connector 92 formed from an electrically conductive material which is substantially cathodic relative to the iron anode 90. According to one exemplary practice, the elongate connector 92 is a threaded stainless steel rod, although other structures may likewise be used if desired. In the illustrated embodiment, the elongate connector 92 extends through a non-conducting plug 94 formed from a material such as nylon or the like held in compressed relation within a wall of the first end cover 40. In this construction, the iron anode 90 is not grounded and is electrically isolated. In the exemplary construction, a ring terminal 96 is held at a position above the non-conducting plug 94 by a nut 98 or other compression member. As shown, the ring terminal 96 is in operative connection with an electronic control module 100 which selectively establishes a grounded electrical connection between the iron anode 90 and the cooling core 30 or other element to be protected against corrosion due to sulfide contaminants. In this grounded relation, the iron anode is galvanically coupled to the element being protected, thereby imposing a potential between the iron anode 90 and the cooling core 30 or other element to be protected. In one contemplated practice, the electronic control module may incorporate a simple switch to establish a grounded relation. If desired, the electronic control module 100 may also include or be operatively connected to a current source such as a battery or the like which may be selectively activated to deliver an impressed current to the iron anode 90.

As will be appreciated, the zinc sacrificial material 82 and the iron anode 90 typically are at least partially surrounded by the cooling media entering through the cooling medium inlet 43. By way of example only, in the event that the heat exchanger 10 is used in a marine application, the cooling media may be seawater, although other cooling solutions may be used if desired. Under these operating conditions, the seawater or other cooling media acts as an electrolyte between the iron anode 90 and the copper alloy tubes 32. The liquid being cooled acts as an electrolyte between the copper alloy tubes 32 and the housing 12.

Galvanic corrosion between two dissimilar metals will normally occur in the presence of an electrolyte. The metal having the lower position within the Galvanic Series of metals will corrode preferentially relative to the metal with the higher position. The corrosion of the metal is an oxidation reaction resulting in the production of electrons. By providing surplus electrons to the metal that is prone to oxidation, the oxidation rate may be substantially suppressed. The corrosion of the metal may also be suppressed by establishing a protective oxide coating across the metal surface.

Typically, the various elements within the core, including endplates, bonnets, tubes and the like are at varying corrosion potentials. Headers are typically the same material as the tubes such that there is no difference in corrosion potential. Bonnets may be selected to be slightly anodic to force corrosion to occur in a non-critical area. In general, tubes tend to corrode at inlet locations for the cooling medium and other areas of turbulence. The zinc sacrificial material 82 provides corrosion protection in these areas. The iron anode 90 is useful in providing enhanced protection further upstream in sulfide environments in the manner as will be described.

In normal seawater conditions, the copper alloy surfaces tend to develop a naturally occurring oxide film. This oxide film substantially suppresses the tendency to corrode. Although this oxide film may build up naturally over time, it may be desirable to treat the copper alloy surfaces subject to corrosion with an oxidizing agent such as ferrous sulfate or the like prior to placing the heat exchanger 10 into service. Such treatment may provide a relatively thick and uniform oxide coating which may be sustained during normal operation.

Under normal operating conditions using ionized water as the coolant, the oxide film on the copper alloy tubes 32 or other copper surfaces within the heat exchanger 10 in combination with cathodic protection provided by the zinc sacrificial material 82 may substantially protect those surfaces from undergoing selective corrosion. In this regard, it will be understood that cathodic protection is achieved by supplying electrons to the metal structure to be protected. In the exemplary arrangement as shown and described, the zinc sacrificial material 82 tends to undergo preferential oxidation according to the following formula:

$$Zn \rightarrow Zn^{2+} + 2e$$

This addition of electrons to the system from zinc oxidation results in the general suppression of oxidation at the copper surfaces as well as at other surfaces formed from metals of higher nobility than Zinc.

While the protection afforded by the oxide coating and the zinc sacrificial material 82 typically is sufficient to protect metal surfaces within the cooling core 30, it has been found that such protective mechanisms may be overwhelmed in the event that the water or other cooling medium includes sulfide contaminants such as hydrogen sulfide or the like. Specifically, such sulfide contaminants may tend to break down the protective oxide film coating on the copper alloy surfaces, thereby exposing the bare metal to the contaminated solution. In normal seawater containing no sulfide, the free corrosion potential of cupro-nickle alloys such as are typically used to form the copper alloy tubes 32, is noble relative to hydrogen evolution. However, the potential is shifted in the presence of sulfide such that hydrogen evolution becomes possible as part of the cathodic reaction and the cupro-nickle becomes subject to oxidation. The hydrogen sulfide reacts with copper ions to produce a non-protective black cuprous sulfide which is poorly adherent. However, the presence of $Fe^{2+}$ can reduce the extent of sulfide induced corrosion due to the establishment of a protective film which acts as a cathodic inhibitor.

In accordance with the present disclosure, the action of sulfide contaminants may be substantially offset by the selective grounding of the iron anode 90. By way of example only, and not limitation, upon sensing a sulfide contaminate within the cooling medium using a sensor (not shown), the electronic control module 100 may activate a switch to complete a grounded circuit between the iron anode 90 and the cooling core 30. This grounding may be done alone, or in combination with delivery of an applied voltage. According to another contemplated practice, in the event that the heat exchanger 10 is being used on a mobile watercraft or other machine, grounding, alone or in combination with an applied voltage, may be provided upon sensing a reduction in velocity of the watercraft indicative of entering a harbor or inland waterway. Activation in response to a reduction in velocity may be useful since sulfide contaminants tend to be most prevalent in harbor or inland waterway regions. Of course, any number of other activation mechanisms may be used as desired.

Regardless of the activation mechanism used, the grounding causes an acceleration of the following reaction:

$$Fe \rightarrow Fe^{2+} + 2e$$

Figure 3:
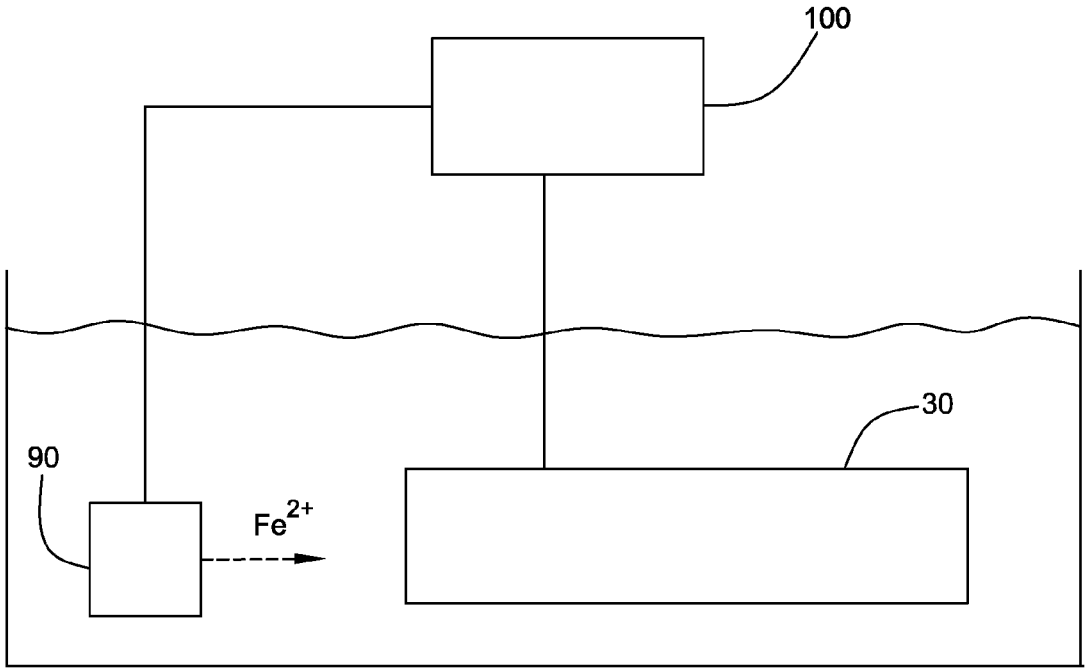
FIG. 3 is a schematic view illustrating the protective mechanism of a grounded iron anode in a heat exchanger.

As best illustrated in FIG. 3, the oxidation of the iron anode 90 results in the delivery of ferrous ions through the cooling medium to the element being protected. As noted above, the presence of ferrous ions in the cooling medium during exposure to sulfide contaminates aids in the protection against sulfide attack. By way of example only, it has been found that delivery of ferrous ions at a concentration of about 0.2 mg/liter within about 2 minutes of contact with the sulfide contaminates will provide significant protection.

Of course, the grounding and optional voltage delivery to the iron anode may be terminated once the threat of sulfide contamination has dissipated. The iron anode 90 will thereafter continue some degree of natural oxidation resulting in ferrous ion generation at a reduced level. This reduced level will nonetheless provide some continuing protection to the oxide film within the system. However, due to the electrically isolated arrangement of the iron anode 90, such natural oxidation will be relatively minimal.

INDUSTRIAL APPLICABILITY

The present disclosure is applicable to virtually any heat exchanger exposed to a treatment or cooling medium which may have sulfide contaminants. The present disclosure may be particularly useful in conjunction with heat exchangers for marine applications where seawater is used as the cooling medium.

In a typical operation, an engine coolant or other fluid to be cooled may be pumped into the inlet 14 of the heat exchanger 10. The fluid to be cooled flows between the copper alloy tubes 32, inside the inner surface of the housing 12, and returns to the engine 61 through the outlet 16. Heat from the treated fluid is transmitted to the copper alloy tubes 32. A cooling medium, such as seawater, is circulated by an external pump and enters the cooling medium inlet 43 in the first end cover 40. The cooling medium flows into the copper alloy tubes 32 for heat transfer. The zinc sacrificial material 82 and the iron anode 90 are at least partially immersed in the cooling medium. Upon the detection of sulfide contaminants and/or the occurrence of pre-established conditions indicating the likely presence of sulfide contaminants in the cooling medium, a grounded circuit is established between the iron anode and the cooling core 30 of the heat exchanger. The grounded circuit promotes the oxidation of the iron anode 90, thereby releasing ferrous ions and free electrons into the cooling medium. The ferrous ions and free electrons aid in suppressing corrosion of the downstream copper alloy surfaces.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A heat exchange system comprising:

a heat exchanger including a housing and a cooling core disposed within the housing, the cooling core adapted to receive a flow of a liquid cooling medium;

at least one iron anode projecting into a flow path of said liquid cooling medium, said at least one iron anode being normally ungrounded; and an electronic control module operatively connected to said at least one iron anode, said electronic control module adapted to control selective electrical grounding of said at least one iron anode in response to at least one predetermined condition indicating the presence of sulfide constituents in said cooling medium, said at least one predetermined condition including at least one of a positive hydrogen sulfide sensor reading and a reduction in velocity of a watercraft using the heat exchange system.

2. The heat exchange system as recited in claim 1, wherein said cooling core includes a plurality of copper alloy surfaces.

3. The heat exchange system as recited in claim 2, wherein at least a portion of said plurality of copper alloy surfaces include an oxide film coating.

4. The heat exchange system as recited in claim 1, wherein said cooling core includes a plurality of copper alloy tubes, and wherein at least a portion of said copper alloy tubes include an oxide film coating.

5. The heat exchange system as recited in claim 1, further including a sacrificial rod projecting into said cooling medium at a position in spaced relation to said cooling core, said sacrificial rod being in electrically contacting relation to at least one of said housing and said cooling core, said sacrificial rod including a sacrificial material of anodic character relative to both of said housing and said cooling core.

6. The heat exchange system as recited in claim 5, wherein said sacrificial material is zinc.

7. The heat exchange system as recited in claim 5, wherein said cooling core includes a plurality of copper alloy surfaces.

8. The heat exchange system as recited in claim 7, wherein at least a portion of said plurality of copper alloy surfaces include an oxide film coating.

9. The heat exchange system as recited in claim 5, wherein said housing is formed from at least one of fabricated steel, aluminum and cast iron, and wherein said cooling core includes a plurality of copper alloy tubes, and wherein at least a portion of said copper alloy tubes include an oxide film coating.

10. A heat exchange system, the heat exchange system comprising:

a heat exchanger including a housing and a cooling core including a plurality of copper alloy surfaces disposed within the housing;

at least a first end cover disposed in opposing relation to a first end surface of said housing, said first end cover defining a first end chamber adapted to accept an ionized aqueous cooling medium flowing to said cooling core;

a sacrificial rod projecting into said first end chamber in spaced relation to said cooling core, said sacrificial rod including a sacrificial material of anodic character relative to both of said housing and said cooling core;

at least one iron anode projecting into said first end chamber in contacting relation with said cooling medium, said at least one iron anode being normally ungrounded; and an electronic control module operatively connected to said at least one iron anode, said electronic control module adapted to control selective grounding of said at least one iron anode in response to at least one predetermined condition indicating the presence of sulfide constituents in said cooling medium, said at least one predetermined condition including at least one of a positive hydrogen sulfide sensor reading and a reduction in velocity of a watercraft using the heat exchange system.

11. The heat exchange system as recited in claim 10, wherein at least a portion of said plurality of copper alloy surfaces include copper alloy tubes having an oxide film coating.

12. The heat exchange system as recited in claim 10, wherein said sacrificial material is zinc.

13. The heat exchange system as recited in claim 10, wherein the housing is fabricated steel.

14. A method of providing enhanced corrosion protection to copper alloy surfaces within a cooling core of a heat exchanger adapted to receive an ionized aqueous cooling medium, wherein the copper alloy surfaces have a pre-established oxide film coating, the method comprising:

providing at least one iron anode projecting into a flow path of said cooling medium upstream of said cooling core; and generating ferrous ions and free electrons from said at least one iron anode by using an electronic control module to selectively ground said at least one iron anode in response to at least one predetermined condition indicating the presence of sulfide constituents in said cooling medium, said at least one predetermined condition including at least one of a positive hydrogen sulfide sensor reading and a reduction in velocity of a watercraft using the heat exchange system.

15. The method of claim 14, further comprising the preliminary step of treating said copper alloy surfaces with an oxidizing agent to form said pre-established oxide film coating.

16. The method of claim 15, wherein said oxidizing agent is ferrous sulfate.

17. A heat exchange system, the heat exchange system comprising:

a heat exchanger including a housing and a cooling core having a plurality of copper alloy surfaces disposed within the housing, the housing being grounded;

a first end cover disposed in opposing relation to a first end surface of said housing, said first end cover defining a first end chamber adapted to accept an ionized aqueous cooling medium therein, said cooling medium in contacting relation with said cooling core;

a sacrificial rod projecting into said first end chamber in spaced relation to said cooling core, said sacrificial rod including a sacrificial material of anodic character relative to both of said housing and said cooling core, said sacrificial rod being grounded;

an iron anode mounted on a connector formed from an electrically conductive material of cathodic character relative to the iron anode, said iron anode projecting into said first end chamber and in contacting relation with said cooling medium, said iron anode being normally ungrounded and electrically isolated from said housing; and an electronic control module operatively connected to said iron anode, said electronic control module adapted to selectively complete a grounded circuit between said iron anode and said cooling core in response to at least one predetermined condition indicating the presence of sulfide constituents in said cooling medium, said at least one predetermined condition including at least one of a positive hydrogen sulfide sensor reading and a reduction in velocity of a watercraft using the heat exchange system.

* * * * *